US005802757A

United States Patent [19]

Duval et al.

[11] Patent Number: 5,802,757

[45] Date of Patent: Sep. 8, 1998

[54] FIREARM WITH RELEASABLY RETAINED SIGHT ASSEMBLY

[75] Inventors: Michael S. Duval, Chicopee; Craig A. Mariani, Ludlow, both of Mass.

[73] Assignee: Smith & Wesson Corp., Springfield, Mass.

[21] Appl. No.: 846,738

[22] Filed: Apr. 30, 1997

[51] Int. Cl.[6] ..... F41G 1/46

[52] U.S. Cl. ..... 42/100; 42/101; 42/103; 33/233

[58] Field of Search ..... 42/100, 101, 103; 33/233

[56] References Cited

U.S. PATENT DOCUMENTS

| | | | |
|---|---|---|---|
| 1,316,482 | 9/1919 | Holden et al. . | |
| 2,030,312 | 2/1936 | Mossberg | 33/47 |
| 2,380,965 | 8/1945 | Harvey | 33/47 |
| 2,727,309 | 12/1955 | Jenkins | 42/100 |
| 3,193,932 | 7/1965 | Johnson | 33/47 |
| 3,826,012 | 7/1974 | Pachmayr | 33/246 |
| 3,838,522 | 10/1974 | Williams | 33/258 |
| 3,945,142 | 3/1976 | Keppeler | 42/1 S |
| 4,130,958 | 12/1978 | Gutridge | 42/1 S |
| 4,200,989 | 5/1980 | Brouthers | 33/257 |
| 4,244,114 | 1/1981 | Strahan | 33/257 |
| 4,328,624 | 5/1982 | Ross | 33/245 |
| 4,388,772 | 6/1983 | Maes | 42/1 S |
| 4,651,432 | 3/1987 | Bornancini | 33/233 |
| 4,760,495 | 7/1988 | Till | 361/412 |
| 5,016,381 | 5/1991 | Ferraro | 42/100 |
| 5,016,382 | 5/1991 | Pickle | 42/100 |
| 5,068,968 | 12/1991 | Sillery | 33/233 |
| 5,202,524 | 4/1993 | Nechushtan | 42/100 |
| 5,384,980 | 1/1995 | Johnson et al. | 42/100 |
| 5,404,667 | 4/1995 | Schmitter | 42/100 |
| 5,426,882 | 6/1995 | Dornaus | 42/100 |
| 5,467,552 | 11/1995 | Cupp et al. | 42/100 |

*Primary Examiner*—Charles T. Jordan
*Assistant Examiner*—Meena Chelliah
*Attorney, Agent, or Firm*—McCormick, Paulding & Hubber

[57] ABSTRACT

A front sight assembly releasably secured to a handgun has a sight body including an integral, resilient, axially elongated and radially expandable anchor pin slideably received within an outwardly open anchor pin retaining bore formed in the muzzle end of the gun barrel. A set screw threadably engaged within the sight body radially expands the anchor pin and maintains it in expanded condition within the retaining anchor pin bore in frictionally gripping engagement with the wall of the retaining bore. An alignment pin projecting form the sight body and slideably received within an outwardly open alignment bore formed in the gun barrel cooperates with the anchor pin to maintain the sight body in a predetermined position of alignment with the gun barrel.

20 Claims, 2 Drawing Sheets

FIREARM WITH RELEASABLY RETAINED SIGHT ASSEMBLY

FIELD OF INVENTION

This invention relates in general to firearms and deals more specifically with an improved firearm having a releasably retained sight assembly.

BACKGROUND OF THE INVENTION

Although the releasably secured sight assembly of the present invention may be used in combination with small arms of all types it is particularly well suited for use in connection with handguns. The sights on a typical handgun may be integrally formed on the gun frame or barrel by a conventional machining process or may comprise discrete members permanently secured to the gun as by pinning or by another conventional mechanical attaching process, such as swaging. Although handgun sights are provided in a variety of sighting configurations, it is usually not economically feasible for a gun manufacturer to furnish a variety of optional sights for each gun model produced.

If a gun sight of the type which is integrally formed on or otherwise permanently secured to a gun should become damaged it is usually necessary to return the gun to the gun manufacturer or otherwise engage the services of a qualified gunsmith to make the necessary repair. Further, if a gun owner should wish to remove and replace the sights on such a gun with other sights which provide a different sighting pattern, in accordance with his or her personal preference, it is usually also necessary to enlist the aid of a skilled gunsmith to make the replacement.

Heretofore, removable sights of various configurations have been provided both as original equipment and after market products. However, such sights usually employ intricate mounting arrangements to assure proper sight alignment and positive sight retention. Extensive machining operations are usually required to produce such sights and to prepare a gun to receive them, all of which adds substantially to the cost of producing a firearm. Consequently, such releasably retained sight assemblies have not gained general acceptance in the firearm field.

Accordingly, it is the general aim of the present invention to provide an improved releasably retained sight assembly for low cost manufacture and installation as original equipment or as an after market product. A further aim of the invention is to provide a sight assembly which may be furnished in a variety of sight configurations for selective assembly with a firearm. Another aim of the invention is to provide a releasably retained sight assembly which may be removed from a gun and replaced with another sight of generally like kind using a simple readily available hand tool to enable sight replacement by a person having ordinary skill.

SUMMARY OF THE INVENTION

A releasably retained sight assembly for a firearm has a sight body including a resilient axially elongated and radially expandable integral anchor pin slideably received within a retaining bore formed in the frame or barrel of a firearm. A manually operable expanding means associated with the sight body is provided for radially expanding the anchor pin within the retaining bore to frictionally grip the wall of the retaining bore and releasably secure the sight assembly in connected relation to the gun.

DETAIL DESCRIPTION OF PREFERRED EMBODIMENT

Figure 1:
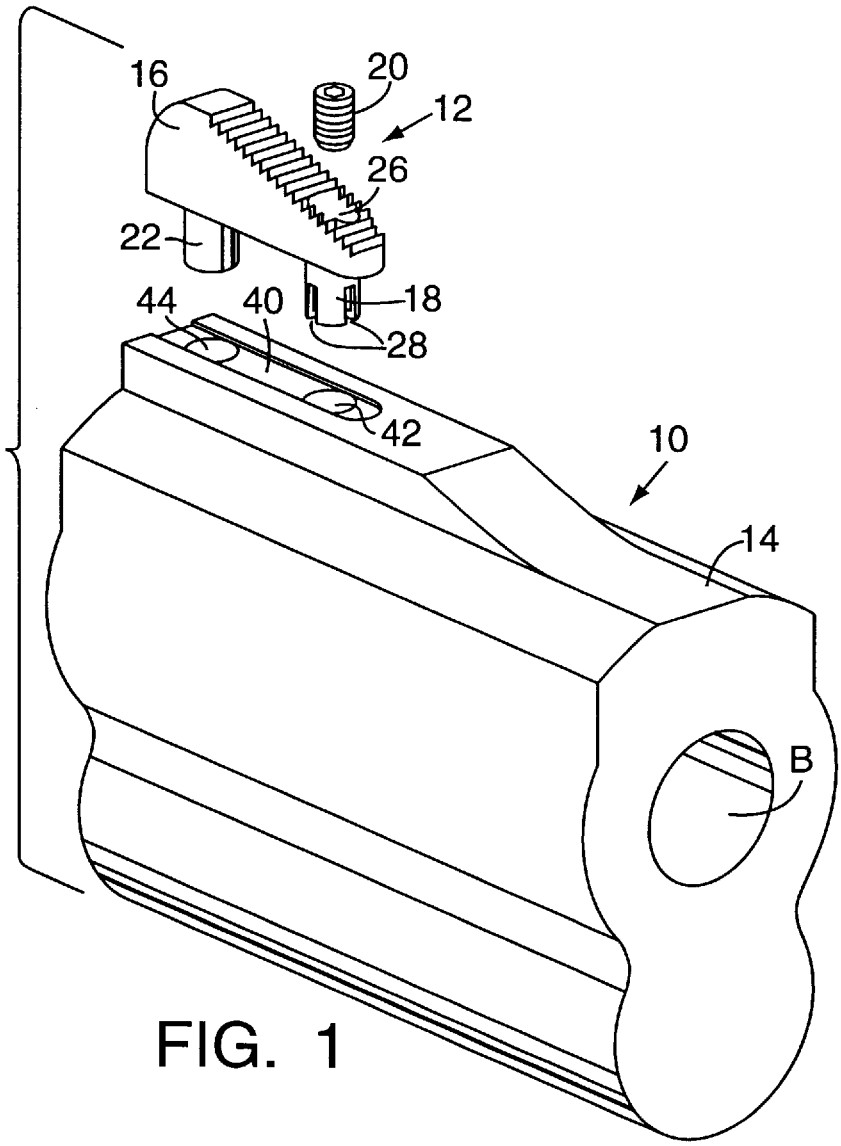
FIG. 1 is an exploded fragmentary perspective view of a handgun barrel and sight assembly embodying the present invention.

In the drawing and in the description which follows, the present invention is illustrated and described with reference to a firearm or handgun indicated generally at 10 and which has a sight assembly designated generally by the reference numeral 12. The handgun 10 has a frame assembly including a barrel 14 constructed and arranged to receive the sight assembly 12, as will be hereinafter further discussed. Since the illustrated sight assembly 12 is configured as a front sight, only the muzzle end of the gun barrel 14 is shown in FIG. 1.

The illustrated sight assembly 12 essentially comprises a sight body 16 which includes an integral radially expandable split anchor or mounting pin 18. The sight assembly 12 also includes an expanding member 20 for cooperating with the anchor pin 18 to expand the anchor pin and thereby releasably secure the sight assembly 12 to the gun 10. Preferably, and as shown in the drawing, the sight assembly 12 also includes an alignment pin 22 for cooperating with the gun frame assembly or more specifically the barrel portion of the frame assembly to maintain the sight body in alignment along a predetermined line of sight relative to the gun bore, indicated by the letter B, all of which will be hereinafter more fully discussed.

Considering now the sight assembly 12 in further detail, the sight body 16 may be made from any suitable material and may be made in various forms to provide a variety of sighting patterns. However, in accordance with presently preferred construction, the sight body 16 comprises a unitary structure made from resilient metal. The sight body is preferably made by a metal injection molding (MIM) process which enables manufacture of a sight body in a wide variety of sight configurations which may require the formation of compound curves and intricate shapes, difficult, if not impossible, to produce by conventional machining processes or which would be prohibitively expensive to produce by such conventional machining processes.

Further referring to the sight body 16, as it appears oriented in the drawing, the upper portion of the sight body defines the sighting portion of the sight assembly. A typical sight configuration is illustrated, however, it should be understood that the sight body may be made in a variety of different shapes to provide differing sighting patterns and such sight body variations are contemplated within the scope of the present invention.

Figure 3:
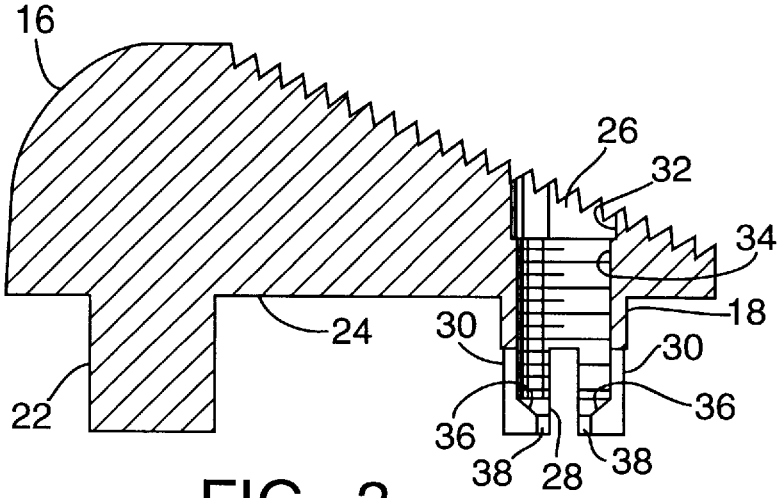
FIG. 3 is a sectional view through the sight body taken along the line 3—3 of FIG. 2.
Figure 4:
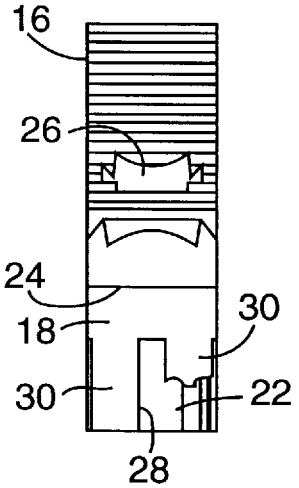
FIG. 4 is a front elevational view of the sight body.
Figure 5:
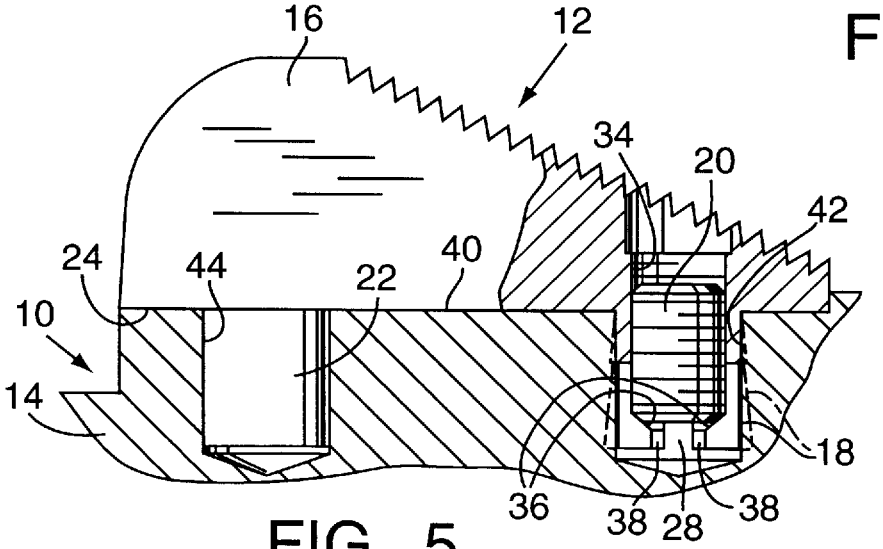
FIG. 5 is a fragmentary sectional view similar to FIG. 3 but shows the sight assembly connected to an associated handgun barrel.

The sight body 16 has a substantially planar downwardly facing mounting surface 24. As previously noted, the anchor pin 18 is integrally formed on the sight body 16 and comprises a generally cylindrical split pin disposed in axially normal relation to and projecting downwardly from the mounting surface 24. Preferably, and as shown, the diameter of the anchor or mounting pin 18 is substantially equal to the lateral width dimension of the mounting surface 24. A generally cylindrical stepped bore 26 extends coaxially downwardly through the anchor pin 18 and opens through the lower end of the pin, as best shown in FIG. 3. The pin bore 26 is preferably formed by the metal injection molding (MIM) process employed in forming the sight body. A plurality of diametrically opposed slots 28, 28 formed in at least the lower portion of the anchor pin extend in axial directions relative to the anchor pin, communicate with the bore 26, and open radially outwardly through the outer side wall and through the lower end wall of the anchor pin 18, as best shown in FIGS. 3 and 5. The slots 28, 28 divide at least a portion of the pin 18 into a plurality of substantially equiangularly spaced pin segments 30, 30 and are also preferably formed by the MIM process.

The bore 26 has a generally cylindrical smooth wall upper end portion 32 which opens upwardly throughout the upper or sighting portion of the sight body 16. A threaded portion of the bore 26, disposed adjacent to and immediately below the smooth walled portion 28, as indicated at 34, extends downwardly for some distance into the anchor pin 18 terminating within the slotted lower end portion of the pin. The threaded portion 34 is also preferably formed by the MIM process. Each pin segment 30 defines a substantially parti-conical upwardly facing expansion surface 36 within the bore 26 and immediately below the threaded portion 34. The expansion surfaces 36, 36 form junctions with the lower end of the threaded portion 34 and lie within a downwardly converging conical surface of revolution having an axis of revolution coincident with the axis of the anchor pin bore 26. Each pin segment 30 has a generally radially inwardly facing parti-cylindrical lower end portion 38 defined by a cylindrical surface having an axis of revolution coincident with the pin bore axis. Each parti-cylindrical portion 38 extends downwardly from the lower end of an associated parti-conical portion 36. The parti-cylindrical portions 38, 38 define the lower end portion of the split pin bore 26.

The illustrated expanding member 20 preferably comprises an Allen head set screw for threadable engagement within the anchor pin bore 26 or more specifically within the threaded portion 34 of the bore. The set screw 20 has a coaxial downwardly converging generally frustoconical surface at its lower end for engaging the expansion surfaces 36, 36 within the split lower end portion of the anchor pin bore. Rotation of the set screw 20 in clockwise direction, as viewed from above, moves the set screw downwardly within the bore 26 causing the frustoconical lower end portion of the set screw to engage the parti-conical expanding surfaces 36, 36 thereby driving the pin segments 30, 30 outwardly in radial directions to radially expand the lower end portion of the anchor pin 18. In FIG. 5 an expanded form of the anchor pin 18 is indicated somewhat schematically in broken lines.

Figure 2:
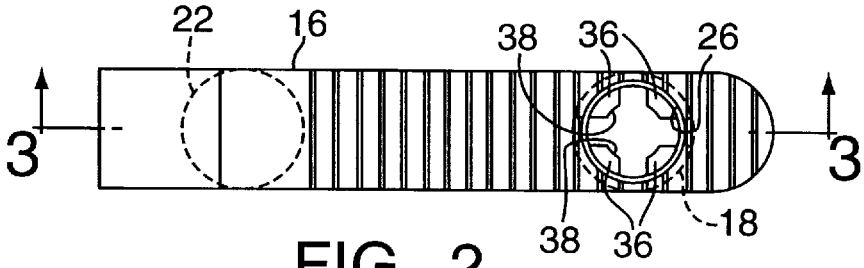
FIG. 2 is top plan view of the sight body shown in FIG. 1.

Preferably, and as best shown in FIGS. 3 and 5 the alignment pin 22 is formed on and comprises an integral part of the sight body 16. The latter pin is generally cylindrical and has a diameter substantially equal to the lateral width dimension of the mounting surface 24, as best shown in FIGS. 2 and 5. The alignment pin 22 is disposed in axially normal relation to the mounting surface 24 and is axially parallel to the anchor pin 18.

The gun barrel 14 has a substantially planar upwardly facing land or seating surface 40 and a pair of generally cylindrical blind bores 42 and 44 axially normal to and opening upwardly through the seating surface 40 for receiving the anchor pin 18 and the alignment pin 22, respectively. The sight assembly 12 is assembled with the gun 10 by slideably inserting the anchor pin 18 and the alignment pin 22 into the complimentary cylindrical bores 42 and 44, respectively, and bringing the mounting surface 24 into abutting engagement with the seating surface 40. The sight assembly 12 is then releasably secured to the gun 10 by rotating the set screw 20 in clockwise direction, as viewed from above, to radially expand the anchor pin 18 within the bore 42, thereby causing the pin segments 30, 30 to tightly engage and frictionally grip the wall of the pin retaining bore 42. The sight assembly 12 may be removed from the gun by simply loosening the set screw 20 and pulling upwardly on the sight assembly relative to the gun barrel.

A gun sight body embodying the present invention may be manufactured in single operation by a metal injection molding (MIM) process and may be produced in a multiplicity of sight configurations to satisfy the sighting requirements of the most discriminating gun owner. The simplicity of the mounting arrangement enables a gun owner having ordinary skill to remove a sight assembly from a gun for repair or replacement by another sight assembly of generally like kind, which provides either the same or a different sight pattern, using a simple, readily available hand tool and without risk of sight misalignment.

We claim:

1. In a firearm having a frame assembly including a barrel having a muzzle end and a gun bore opening through the muzzle end, and a sight assembly mounted on the frame assembly, the improvement comprising said frame assembly having an outwardly open sight mounting bore defined by a bore wall, said sight assembly including a sight body having a gun sighting portion and an integral axially elongated radially expandable anchor pin axially projecting from said sighting portion and slideably received within said sight mounting bore, and expanding means supported by said sight body for radially expanding said anchor pin into and maintaining said anchor pin in frictional gripping engagement with said bore wall to releasably secure said sight assembly in assembled relation with said frame assembly.

2. In a firearm as set forth in claim 1 the further improvement wherein said expanding means includes an expansion member supported for manual movement in one an opposite direction relative to said sight body between sight securing and sight releasing positions.

3. In a firearm as set forth in claim 2 the further improvement wherein said expanding means comprises coengageable surfaces on said expansion member and said anchor pin.

4. In a firearm as set forth in claim 3 the further improvement wherein said anchor pin comprises a split pin having a coaxial anchor pin bore including a threaded portion and expansion member is threadably engaged with said threaded portion.

5. In a firearm as set forth in claim 4 the further improvement wherein said expansion member comprises a set screw wholly disposed within said anchor pin bore.

6. In a firearm as set forth in claim 2 the further improvement wherein said sight body has a generally cylindrical stepped anchor pin bore extending coaxially through said anchor pin and opening through said sight defining portion, said anchor pin has side and end walls and diametrically opposed slots extending in axial directions relative to the axis of said anchor pin bore and opening radially into said anchor pin bore and outwardly through said side and end walls, said slots dividing at least a portion of said anchor pin into a plurality of angularly spaced segments having axially inwardly facing expansion surfaces disposed within said anchor pin bore, and said expansion member comprises a set screw threadably engaged with said anchor pin within said anchor pin bore and having a bearing surface engageable with said expansion surfaces.

7. In a firearm as set forth in claim 6 the further improvement wherein said expansion surfaces comprise parti-conical surfaces defined by a conical surface of revolution having an axis of revolution coincident with the axis of said anchor pin bore.

8. In a firearm as set forth in claim 6 the further improvement wherein said bearing surface comprises a frustoconical surface.

9. In a handgun as set forth in claim 1 the further improvement wherein said sight assembly is further characterized as a front sight assembly and said sight mounting bore is formed in said barrel proximate said muzzle end.

10. In a firearm as set forth in claim 1 the further improvement wherein said sight body includes an integral alignment pin projecting from said sighting portion in axially parallel relation to said anchor pin.

11. In a firearm as set forth in claim 10 the further improvement wherein said sighting portion has a substantially planar mounting surface and said anchor pin and said alignment pin are axially normal to said mounting surface.

12. A firearm sight assembly comprising a sight body having a sighting portion and including an integral axially elongated radially expandable anchor pin projecting from said sighting portion, and manually operable expanding means carried by said sight body for radially expanding said anchor pin.

13. A firearm sight assembly as set forth in claim 12 wherein said sight body has an integral axially elongated alignment pin axially projecting from said sighting portion in generally axially parallel relation to said anchor pin.

14. A sight assembly as set forth in claim 12 wherein said sighting portion has a substantially planar mounting surface and said anchor pin and said alignment pin are disposed in axially normal relation to said mounting surface.

15. A sight assembly as set forth in claim 12 wherein said sight body has a generally cylindrical stepped bore extending coaxially through said anchor pin and opening through said sighting portion, said anchor pin has a side wall and an end wall and generally diametrically opposed slots extending in axial directions relative to the axis of said anchor pin bore and opening radially into said anchor pin bore and outwardly through said side and end walls of said anchor pin, said slots dividing a portion of said anchor pin into a plurality of angular spaced segments defining expansion surfaces disposed within said anchor pin bore, and said expansion member comprises a set screw threadably engaged with said anchor pin within said anchor pin bore and engageable with said expansion surfaces to radially expand said anchor pin in response to rotation of said set screw in one direction relative to said sight body.

16. A firearm sight assembly as set forth in claim 15 wherein said expansion surfaces comprise parti-conical surfaces defined by a conical surface of revolution having an axis of revolution coincident with the axis of said anchor pin bore.

17. A firearm sight as set forth in claim 16 wherein said set screw has a frustoconical surface engageable with said expansion surfaces.

18. A firearm having a frame assembly including a barrel having a muzzle end and an axially elongated gun bore opening through said muzzle end, said frame having a substantially planar upwardly facing seating surface and a pair of generally cylindrical axially spaced apart blind cylindrical bores substantially normal to and opening upwardly through said seating surface, and a sight assembly releasably secured to said frame and including a sight body having an upper portion defining a gun sight and a substantially planar downwardly facing mounting surface disposed in generally abutting engagement with said seating surface, said sight body having an integral generally cylindrical anchor pin axially projecting from said mounting surface and slideably received within and substantially complimenting an associated portion of one of said blind bores, said sight body having a stepped generally cylindrical anchor pin bore extending coaxially through said anchor pin and opening upwardly through said upper portion, said anchor pin having side and lower end walls and generally diametrically opposed slots in the lower end portion thereof extending in axial directions relative to the axis of said anchor pin bore and opening radially into said anchor pin bore and outwardly through said side and lower end walls, said slots dividing said lower end portion into a plurality of angularly spaced apart segments having axially upwardly facing parti-conical expansion surfaces disposed within said anchor pin bore and defined by a conical surface of revolution having an axis of revolution coincident with the axis of said anchor pin bore, said anchor pin body having an integral generally cylindrical alignment pin axially projecting from said mounting surface and slideably received within and substantially complimenting an associated portion of the other of said blind bores, said sight assembly including a set screw threadably engaged within said anchor pin bore and bearing upon and cooperating with said expansion surfaces radially expanding said lower end portion into frictional gripping engagement with said sight body within said one of said blind bores and releasably retaining said sight assembly in assembled relationship with said gun frame, said alignment pin cooperating with said anchor pin to maintain said gun sight in predetermined position of alignment with the axis of said gun bore.

19. A firearm as set forth in claim 18 wherein said set screw has a generally frustoconical surface engaging and bearing upon said parti-conical expansion surfaces.

20. A firearm as set forth in claim 18 wherein said firearm is a handgun, said sight assembly comprises a front sight assembly, and said blind bores are formed in said barrel proximate said muzzle end.

* * * * *